US006458063B2

(12) United States Patent
Kodama

(10) Patent No.: US 6,458,063 B2
(45) Date of Patent: Oct. 1, 2002

(54) SEMICONDUCTIVE ROLLER AND IMAGE FORMING APPARATUS

(75) Inventor: Yasumoto Kodama, Saitama (JP)

(73) Assignee: Shin-Etsu Polymer Co., Ltd., Tokyo (JP)

( * ) Notice: Subject to any disclaimer, the term of this patent is extended or adjusted under 35 U.S.C. 154(b) by 0 days.

(21) Appl. No.: 09/847,482

(22) Filed: May 2, 2001

(51) Int. Cl.[7] ..... B25F 5/02
(52) U.S. Cl. ..... 492/59; 399/176
(58) Field of Search ..... 492/59, 56, 58, 492/57; 428/620, 364; 399/176

(56) References Cited

U.S. PATENT DOCUMENTS 5,553,845 A * 9/1996 Sawa et al. ..... 271/272
5,609,554 A * 3/1997 Hayashi et al. ..... 492/53
5,669,605 A * 9/1997 Sawa et al. ..... 271/109
5,753,154 A * 5/1998 Hayashi et al. ..... 156/79
6,283,904 B1 * 9/2001 Itoh et al. ..... 399/176

* cited by examiner

*Primary Examiner*—I Cuda Rosenbaum
(74) *Attorney, Agent, or Firm*—Darby & Darby

(57) ABSTRACT

A semiconductive roller forming an elastic layer on the outer circumference of a conductive shaft body, in which the elastic layer is an unfoamed body having the addition curing type liquid silicone rubber cured as a base polymer, and the ASKER C hardness of this unfoamed body is 10° to 50°. This semiconductive roller is used as a rotatable developing roller of an image forming apparatus such as a printer.

2 Claims, 3 Drawing Sheets

SEMICONDUCTIVE ROLLER AND IMAGE FORMING APPARATUS

BACKGROUND OF THE INVENTION

1. Field of the Invention

The present invention relates to a semiconductive roller useful as a developing roller, and an image forming apparatus comprising the same such as copier, printer or facsimile apparatus.

2. Description of the Prior Art

A semiconductive roller is composed by covering the outer circumference of a conductive shaft body with an elastic layer, and is presented for various applications, and one of such applications is the image forming apparatus such as an electrophotographic printer.

The image forming apparatus of this type comprises a photoreceptor drum 10 as shown in FIG. 8, and this photoreceptor drum is surrounded by a charging roller 11 for charging the drum at a constant potential, an LED array 12 as an exposure unit for forming a latent image on the drum surface, a developing roller 13 for applying toner to the latent image so as to obtain a visible toner image, a transfer roller 15 for transferring the toner image of the photoreceptor drum material on a recording paper 14, a cleaning roller 16, and others, and further a toner conveying roller 17, a friction electrifying blade 18, a toner agitator 19 and others are disposed in the vicinity thereof. The image forming apparatus having such configuration functions to support the friction electrified toner on the outer circumference of the developing roller 13 in a thin layer state, and develop and visualize the formed electrostatic latent image.

The semiconductive roller is used as developing roller 13 or the like for such image forming apparatus, and in this case, aside from mechanical properties, it is required to have various properties including conductivity, environmental resistance, low hardness, and friction electrifying characteristic. Accordingly, the semiconductive roller is composed of urethane rubber, NBR, EPDM rubber, silicone rubber or similar material, and by adding and blending conductivity donor such as electroconductive substance or ion conductive substance.

When the semiconductive roller is used as the developing roller 13, it rotates while keeping contact with the photoreceptor drum 10 or friction electrifying blade 18, and it is important to contact closely with them more uniformly and in a wider nip. Therefore, the developing roller 13 is required to have a low hardness, instead of high hardness. Being low hardness is effective from the viewpoint of driving torque and damage to the toner.

Hitherto, to lower the hardness of the semiconductive roller, either one of the following methods has been employed: (1) a method of lowering the hardness by adding process oil, softening agent or other liquid, and forming a protective layer of urethane resin or nylon resin on the surface for prevention of bleeding of the liquid, and (2) a method of covering the outer circumference of the rubber foamed body with unfoamed rubber.

In the method of (1), however, by using the liquid softening agent, the environmental resistance is impaired, and the electrical properties and volume are changed by change in temperature or humidity. Furthermore, prevention of bleeding is not satisfactory, and other members may be contaminated.

In the method of (2), the outer circumference of the rubber foamed body is covered with unfoamed rubber, but in this case since the covering layer needs a certain thickness in order to lessen the effect of cells of the lower layer, it is contrary to reduction of hardness. In addition, since the conductive layer is a foamed body, the electrical characteristics are not stable, and it is very difficult to polish and finish the roller surface at high dimensional precision after covering.

SUMMARY OF THE INVENTION

The present invention is devised in the light of the above problems, and it is hence an object thereof to present a semiconductive roller of low hardness, excellent in environmental resistance, superior in resistance distribution and polishing processability, and capable of obtaining excellent images in a wide range of conditions, and an image forming apparatus.

The present inventor intensively studied in order to solve the problems, and came to conclusion that the object may be achieved by composing the semiconductive roller in a multi-layer structure by forming an elastic layer in an unfoamed body of addition curing type liquid silicone rubber, and combining this unfoamed body with various outer layers.

In accordance with a first aspect of the invention, a semiconductive roller comprises an elastic layer formed on the outer circumference of a conductive shaft body, wherein the elastic layer is an unfoamed body having the addition curing type liquid silicone rubber cured as a base polymer, and the ASKER C hardness of this unfoamed body is 10° to 50°.

In accordance with a second aspect of the invention, an image forming apparatus comprises a semiconductive roller comprising an elastic layer formed on the outer circumference of a conductive shaft body, wherein the elastic layer is an unfoamed body having addition curing type liquid silicone rubber cured as a base polymer, and the ASCA C hardness of this unfoamed body is 10° to 50°.

Preferably, the outer circumference of the elastic layer is preferably covered with a semiconductive unfoamed rubber elastic layer. Also, the outer circumference of the elastic layer should be provided with either a surface layer of a crosslinking resin or a surface-treated layer. Further, the outer circumference of the elastic layer is preferably covered with a semiconductive unfoamed rubber elastic layer, and the outer circumference of this unfoamed rubber elastic layer is preferably provided with either a surface layer of a crosslinking resin or a surface-treated layer.

DESCRIPTION OF THE PREFERRED EMBODIMENTS

Figure 1:
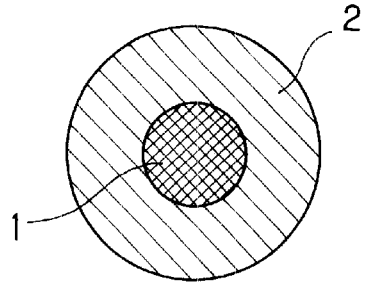
FIG. 1 is a sectional explanatory diagram showing an embodiment of semiconductive roller of the present invention.
Figure 8:
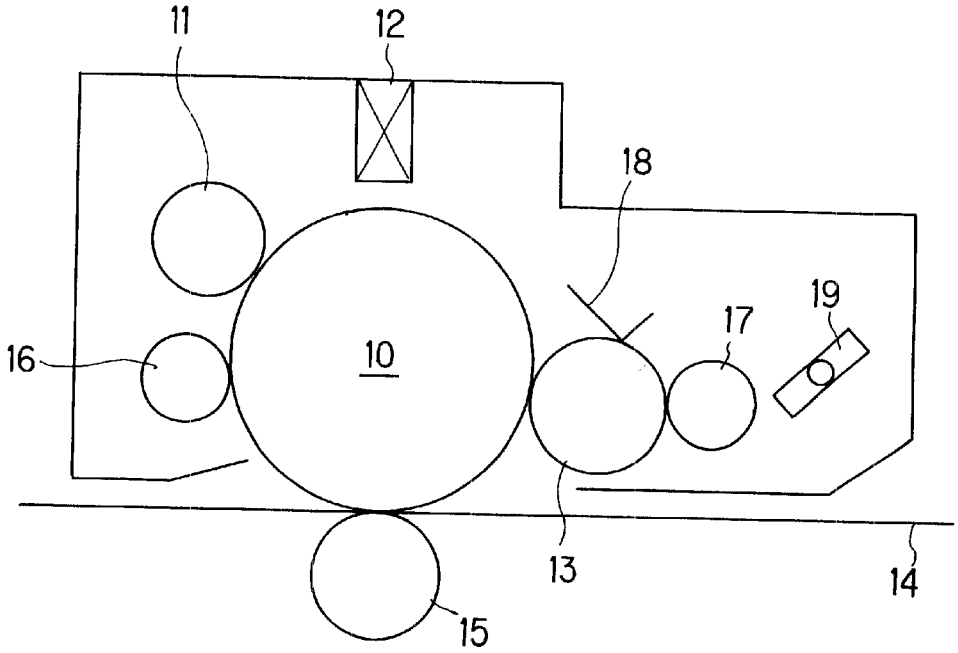
FIG. 8 is a sectional explanatory diagram showing an image forming apparatus.

Explaining preferred embodiments by referring to the drawings, a conductive roller in an embodiment comprises, as shown in FIG. 1, a conductive shaft body 1, and a cylindrical elastic layer 2 formed to cover the outer circumference of the shaft body 1, and this elastic layer 2 is made of an unfoamed body having an addition curing type liquid silicone rubber cured as base polymer. As shown in FIG. 8, it is used as a rotatable developing roller 13 of an image forming apparatus such as printer.

The shaft body 1 is formed as a cylindrical column made of iron, aluminum, SUS, brass or other core metal. Or it may be made of a plated core of thermoplastic resin or thermosetting resin, or made of thermoplastic resin or thermosetting resin blended with conductivity donor such as carbon black or meal powder. Thus composed shaft body 1 is grounded at one end, and a bias voltage is applied, and it functions to charge the electrostatic latent image carrier, inject electric charge into the toner, attract the toner, and develop the electrostatic latent image by conveying the toner from the electrostatic latent image carrier.

The elastic layer 2 is made of an unfoamed body having an addition curing type liquid silicone rubber cured as base polymer, and its ASKER C hardness is set in a range of 10° to 50°. The reason why ASKER C hardness is in a range of 10° to 50° is because, if the hardness is less than 10°, the permanent compressive strain is large, and the semiconductive roller may be deformed, or if the hardness is more than 50°, the hardness cannot be lowered. The addition curing type liquid silicone rubber is generally called LIMS (liquid injection molding system) or LSR (liquid silicone rubber), and it can form an unfoamed hard elastic body that cannot be achieved by the HCR. This addition curing type liquid silicone rubber is mainly composed of polyorganosiloxane containing vinyl radical, and a base compound is prepared by blending with silica reinforcing filler, conductive agent, organohydrogen polysiloxane, platinum catalyst, reaction regulator, function-free silicone oil, and other additives for providing with various characteristics, and it is a type of rubber which is cured by heating.

The principal material, polyorganosiloxane, is not particularly limited as far as it has two or more reaction radicals in one molecule, and preferably the material having alkenyl radicals or hydroxyl radicals expressed in the following average composition formula is used.

$$R_aSiO_{(4-a)/2}$$

where R is selected from alkenyl radical, hydroxyl radial, and monovalent hydrocarbon radical, and at least two radicals are alkenyl radicals or hydroxyl radicals, and "a" is a number ranging from 1.95 to 2.05.

The alkenyl radical R includes vinyl radical and allyl radical with 2 to 4 carbon atoms. Other R than alkenyl radical and hydroxyl radical is monovalent hydrocarbon radical having 1 to 12 carbon atoms, including, for example, alkyl radicals such as methyl radical, ethyl radical, propyl radical, butyl radical and pentyl radical, and aryl radicals such as cyclohexyl radical, phenyl radical, and benzyl radical. As polyorganosiloxane, a straight chain dimethyl polysiloxane having both ends closed with vinyl dimethyl silyl radical is preferred.

The addition curing type liquid silicone rubber is of two-pack or one-pack type generally having a viscosity of about 100 to 5000 poise.

Conductive agents added to the addition curing type liquid silicone rubber include electron conductive agent and ion conductive agent. The electron conductive agent includes conductive carbons such as Ketienblack, acetylene black, etc; carbons for rubber such as SAF, ISAF, HAF, FEF, GPF, SRF, FT, MT, etc; oxidation-treated carbon for ink; pyrolysis carbon; graphite; conductive metal oxides such as tin oxide, titanium oxide, zinc oxide, etc.; metals such as nickel, copper, etc.

The ion conductive agent includes one selected from perchlorate, chlorate, hydrochloride, borate, iodate, borohydrofluoride, sulfate, ethyl sulfate, carboxylate, sulfonate, etc. of such ammonium salts as one selected from tetraethyl ammonium, tetrabutyl ammonium, octadecyl trimethyl ammonium, dodecyl trimethyl ammonium, hexadecyl trimethyl ammonium, benzyl trimethyl ammonium, denatured aliphatic dimethyl ammonium, etc.; perchlorate, chlorate, hydrochloride, borate, iodate, borohydrofluoride, trifluoromehyl sulfate, sulfonate and others of lithium, sodium, calcium, magnesium, and other alkaline metals, or alkaline earth metals. By adding these conductive agents, the elastic layer 2 is adjusted to a resistance value of $10^4$ to $10^{10}$ Ω.

The elastic layer 2 is not particularly limited, and may be formed by a known method. The addition curing type liquid silicone rubber is injected into the mold combined with the shaft and crosslinked by heating, by using the material feeder and the injection molding machine, so that it can be formed while maintaining an excellent productivity. The elastic layer 2 is not limited to one layer, but may be also formed of two layers, and in the case of two layers, a preformed tubular outer layer material and a shaft are set in the mold, and the addition curing type liquid silicone rubber may be similarly injected. If necessary, at this time, an adhesive may be applied to the inner surface of the tubular outer layer material. In other method, a roller of addition curing type liquid silicone rubber and an outer layer material are individually formed, and then press-inserted and adhered. The roller thus obtained may be further post-cured in order to stabilize the resistance and outside diameter when grinding by a grinder in order to adjust the outside diameter.

Figure 2:
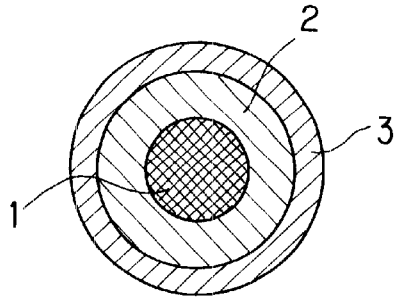
FIG. 2 is a sectional explanatory diagram showing a second embodiment of semiconductive roller of the present invention.

FIG. 2 shows a second embodiment of the present invention, in which a semiconductive unfoamed rubber elastic layer 3 of higher strength than that of the elastic layer 2 is applied on the outer circumference of the elastic layer 2 selectively by way of an adhesive layer, and the semiconductive roller is formed in a two-layer structure.

In this case, the unfoamed rubber elastic layer 3 is formed in a two-layer structure, and is adjusted in the ASKER C hardness within 50°. That is, when a rubber material of higher hardness is used, it is formed thinly. The unfoamed rubber elastic layer 3 is not particularly limited in the material, strength and hardness, but it is an elastic body having conductive agents and others added to the rubber material.

Rubber materials include nitrile rubber, ethylene propylene rubber (including ethylene propylene diene rubber), styrene butadiene rubber, butadiene rubber, isopropylene rubber, natural rubber, silicone rubber, acrylic rubber, chloroprene rubber, butyl rubber, epichlorohydrine rubber, and urethane rubber, which may be used either alone or in a mixture of two or more types. Among them, silicone rubber is most preferred owing to its excellent charging characteristic to the toner and simultaneous processability of crosslinking and adhesion with the addition curing type silicone rubber. Other parts are same as in the foregoing embodiment, and the explanation is omitted.

In this embodiment, the same actions and effects as in the foregoing embodiment are expected, and moreover it is evident that the insufficient strength and wear resistance of the addition curing type silicone rubber can be improved, and surface tackiness is weakened.

Figure 3:
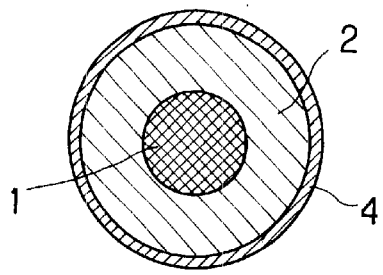
FIG. 3 is a sectional explanatory diagram showing a third embodiment of semiconductive roller of the present invention.

FIG. 3 shows a third embodiment of the present invention, in which a surface layer 4 formed on the outer circumference of the elastic layer 2 selectively by way of an adhesive layer of primer or the like, and the semiconductive roller is formed in a two-layer structure. The surface layer 4 is made of crosslinking synthetic resin or the like, and formed in a thickness of about 1 to 30 $\mu$m.

The crosslinking synthetic resin refers to a resin which is crosslinked by itself by heat, catalyst, air (oxygen), moisture (water), UV, electron beam, etc., or a resin which is crosslinked by reaction with crosslinking agent or other crosslinking resin. Specific examples are polyester resin, polyether resin, fluorine resin, epoxy resin, amino resin, polyamide resin, acrylic resin, acrylic urethane resin, urethane resin, alkyd resin, phenol resin, melamine resin, urea resin, silicone resin, polyvinyl butyrate resin, and their denatured and blended resins having reaction radicals such as hydroxyl radical, carboxyl radical, acid anhydride radical, amino radical, imino radical, isocyanate radical, methylol radical, alkoxy methyl radical, aldehyde radical, mercapto radical, epoxy radical, and unsaturated radical. Among them, considering the charging characteristic to the toner and non-contamination of other members, silicone resin, urethane resin, polyester resin, and polyamide resin are preferred.

In the synthetic resin of the surface layer 4, further, various additives such as conductive agent, charge regulator and resin beads may be blended in order to provide with functions of conductivity, charging performance, toner conveying property, etc. The synthetic resin of the surface layer 4 may be dissolved or dispersed in a solvent, and applied in a known method such as spray method, dip method and roll coater method, and dried, and crosslinked and cured in specified conditions. Other parts are same as in the foregoing embodiments.

In this embodiment, the same actions and effects as in the foregoing embodiments are expected, and moreover the charging property and adhering property to the toner can be adequately controlled, and friction with photoreceptor and layer forming blade can be reduced, and it is evident that the prevention of contamination of photoreceptor and toner is highly expected.

Figure 4:
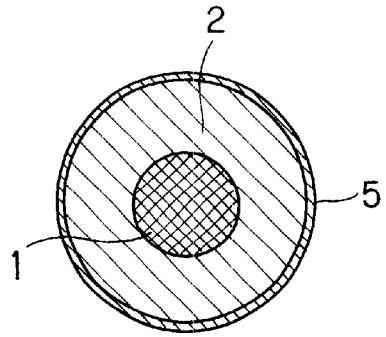
FIG. 4 is a sectional explanatory diagram showing a fourth embodiment of semiconductive roller of the present invention.

FIG. 4 shows a fourth embodiment of the present invention, in which a surface treatment layer 5 of coupling agent or the like is formed on the outer circumference of the elastic layer 2, and the semiconductive roller is formed in a two-layer structure.

The surface treatment layer 5 is composed of a coupling agent of silane, titanium, or aluminum type having a functional radical such as vinyl radical, epoxy radical, mercapto radical, amino radical, or alkoxy radical. In particular, the amino silane coupling agent is preferred because the positive charging property is excellent in the developing device using a negative charge toner. The surface treatment layer 5 may be dissolved or dispersed in a solvent, and applied in a known method such as spray method, dip method and roll coater method, and dried, and crosslinked and cured in specified conditions. Other parts are same as in the foregoing embodiments, and the explanation is omitted.

Figure 5:
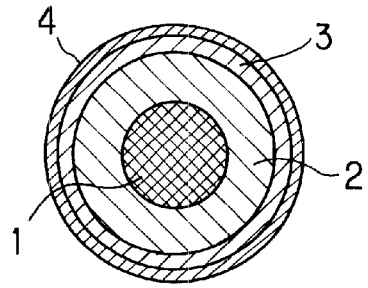
FIG. 5 is a sectional explanatory diagram showing a fifth embodiment of semiconductive roller of the present invention.

FIG. 5 shows a fifth embodiment of the present invention, in which an unfoamed rubber elastic layer 3 is formed on the outer circumference of the elastic layer 2 selectively by way of a adhesive layer, and further a surface layer 4 is formed on the outer circumference of this unfoamed rubber elastic layer 3, so that the semiconductive roller is formed in a three-layer structure. Other parts are same as in the foregoing embodiments.

Figure 6:
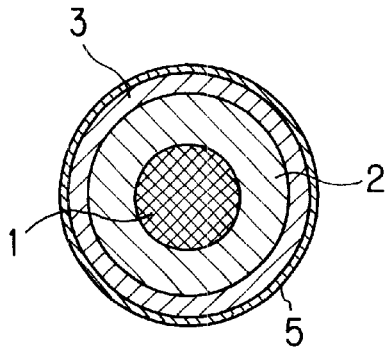
FIG. 6 is a sectional explanatory diagram showing a sixth embodiment of semiconductive roller of the present invention.

FIG. 6 shows a sixth embodiment of the present invention, in which an unfoamed rubber elastic layer 3 is formed on the outer circumference of the elastic layer 2 selectively by way of a adhesive layer, and further a surface treatment layer 5 is foamed on the outer circumference of this unfoamed rubber elastic layer 3, so that the semiconductive roller is formed in a three-layer structure. Other parts are same as in the foregoing embodiments, and the explanation is omitted.

The semiconductive roller of the present invention is not limited to these embodiments alone. For example, the semiconductive roller may be used as charging roller 11 or transfer roller 15, instead of developing roller 13.

Embodiments

The present invention is further specifically described below by referring to examples and comparative examples.

EXAMPLE 1

As a conductive shaft body 1, a shaft of SUS22 with electroless nickel plating of 12 mm in diameter and 250 mm in length was used. On this shaft body 1, silicone primer No. 16 (tradename of Shin-Etsu Chemical) was applied, and baked for 10 minutes in a Geer oven at 150° C. After baking, the shaft body 1 was set in a die, and a two-pack type conductive addition curing type liquid silicone rubber compound was injected in the die to adjust the ASKER C hardness after curing to 30°, and cured for 30 minutes at 120° C., and a semiconductive roller of 20 mm in diameter (elastic layer 4 mm), ASKER C hardness of 30°, and volume resistivity of 4E+06 Ω was fabricated.

EXAMPLE 2

A conductive silicone rubber compound with the JIS A hardness after curing adjusted to 60° was wound around a shaft of 19 mm in diameter, and press-heated and cured for 5 minutes at 200° C. It was ground to a diameter of 20 mm by a cylindrical grinder, and the shaft was extracted, and a silicone rubber tube of 20 mm in diameter, 19 mm in inside diameter, and 1E+06 Ωin volume resistivity was obtained.

The same shaft with primer as used in example 1 was inserted into this silicone rubber tube, and set in the die, and the same two-pack type conductive addition curing type liquid silicone rubber compound as used in example 1 was injected in the die, and cured for 30 minutes at 120° C., and a semiconductive roller of 20 mm in diameter (addition curing type silicone rubber layer 3.5 mm, silicone rubber tube layer 0.5 mm), ASKER C hardness of 40° and volume resistivity of 2E+06 Ω was fabricated.

EXAMPLE 3

On the outer circumference of the rubber portion of the semiconductive roller obtained in example 1, a conductive urethane paint of two-pack type was applied by a spray coater in a film thickness of 20 μm. It was dried and cured for 30 minutes in a Geer oven at 200° C., and a semiconductive roller of two-layer structure of ASKER C hardness of 31° and volume resistivity of 6E+06 Ω was fabricated.

EXAMPLE 4

On the outer circumference of the semiconductive roller obtained in example 2, a conductive urethane paint of two-pack type was applied by a spray coater in a film thickness of 20 μm. It was dried and cured for 30 minutes in a Geer oven at 200° C., and a semiconductive roller of two-layer structure of ASKER C hardness of 41° and volume resistivity of 1E+06 Ω was fabricated.

EXAMPLE 5

On the outer circumference of the semiconductive roller obtained in example 1, an amino silane coupling agent was applied by a spray coater. It was dried and cured for 30 minutes in a Geer oven at 120° C., and a semiconductive roller of three-layer structure of ASKER C hardness of 30° and volume resistivity of 8E+06 Ω was fabricated.

EXAMPLE 6

On the outer circumference of the semiconductive roller obtained in example 2, an amino silane coupling agent was applied by a spray coater. It was dried and cured for 30 minutes in a Geer oven at 120° C., and a semiconductive roller of three-layer structure of ASKER C hardness of 30° and volume resistivity of 7E+06 Ω was fabricated.

COMPARATIVE EXAMPLE 1

A semiconductive roller was fabricated in the same procedure as in example 1 except that a two-pack type addition curing type liquid silicone rubber compound with ASKER C hardness after curing of 8° was used instead of the addition curing type silicone rubber in example 1, and the volume resistivity of this roller was 2E+06 Ω.

COMPARATIVE EXAMPLE 2

In the same procedure as in example 1 except that the addition curing type silicone rubber was adjusted to have ASKER C hardness after curing of 55°, a semiconductive roller with the volume resistivity of 3E+06 Ω was obtained.

COMPARATIVE EXAMPLE 3

Figure 7:
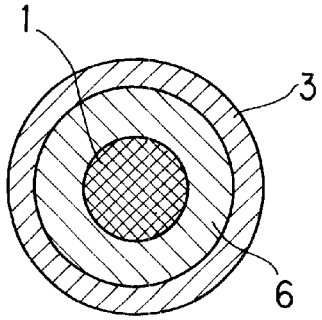
FIG. 7 is a sectional explanatory diagram showing comparative example 3.

A conductive silicone rubber compound adding a proper amount of foaming agent was integrally extruded into a shaft with primer same as in example 1 by using an extruder, and heated, foamed and cured for 6 minutes in an IR oven at 300° C., and dried for 6 hours in a Geer oven at 200° C., and the obtained foamed roller was ground to a diameter of 19 mm. Further, a same silicone tube as used in example 2 was inserted and adhered to coat, and a semiconductive roller of 20 mm in diameter (foamed silicone rubber layer 3.5 mm, unfoamed silicone rubber tube layer 0.5 mm), ASKER C hardness of 40° and volume resistivity of 3E+06 Ω was fabricated (see FIG. 7).

Evaluation items

Semiconductive rollers obtained in these examples were installed as developing rollers of electrophotographic printer using a commercial negative charge toner, and the printing characteristics were evaluated in the following items.

Hardness:

Measured by ASKER C hardness meter (Kobunshi Keiki Co.) conforming to SRIS 0101 (Standard of Rubber Industrial Society) and JIS C 6050.

Roller Resistance:

A roller was put on a gold-plated electrode, a weight of 500 g was suspended on both ends of the roller, and 10 V was applied, and the electric resistance between the shaft and rubber surface layer was measured.

Durability:

Printing 6000 sheets of 5% duty image and similarly printing evaluation pattern, durability data were obtained.

Fog:

The Macbeth density of blank area of 5% duty image was measured by a Macbeth densitometer, and in both initial and aged results, it was approved at 0.015 or less, and rejected at over 0.015.

Printing Density:

The Macbeth density of black solid print was measured by a Macbeth densitometer, and in both initial and aged results, it was approved at 1.3 or more, and rejected at less than 1.3.

Uneven tone: Printing gray tone, presence or absence of uneven tone of developing roller period was investigated.

Evaluation results of examples 1, 2, 3, 4, 5, 6, and comparative examples 1, 2, 3 are summarized in Table 1.

TABLE 1

| | | Example 1 | Example 2 | Example 3 | Example 4 | Example 5 | Example 6 | Comparative Example 1 | Comparative Example 2 | Comparative Example 3 |
|---|---|---|---|---|---|---|---|---|---|---|
| ASKER C hardness | | 30 | 40 | 31 | 41 | 30 | 30 | 8 | 55 | 40 |
| Roller resistance (M Ω) | | 4 | 2 | 6 | 1 | 8 | 7 | 2 | 3 | 3 |
| Fog | Initial | 0.011 | 0.010 | 0.013 | 0.012 | 0.009 | 0.009 | 0.017 | 0.016 | 0.016 |
| | Aged | 0.010 | 0.010 | 0.012 | 0.011 | 0.009 | 0.009 | 0.014 | 0.015 | 0.014 |
| Printing density | Initial | 1.38 | 1.39 | 1.34 | 1.35 | 1.41 | 1.43 | 1.40 | 1.35 | 1.35 |
| | Aged | 1.36 | 1.35 | 1.32 | 1.33 | 1.38 | 1.39 | 1.38 | 1.26 | 1.31 |
| Uneven tone | Initial | Absent | Absent | Absent | Absent | Absent | Absent | Absent | Absent | Present |
| | Aged | Absent | Absent | Absent | Absent | Absent | Absent | Present | Absent | Present |

Thus, according to the present invention, since the elastic layer is an unfoamed body having addition curing type liquid silicone rubber cured as base polymer, and the ASKER C hardness of this unfoamed body is 10° to 50°, the semiconductive roller can be reduced in hardness. Moreover, it is also effective to enhance the environmental durability, resistance distribution, and grinding processability. Further, when used in an image forming apparatus, an excellent image can be obtained in a wide range of conditions.

What is claimed is:

1. A semiconductive roller comprising: an elastic layer formed on the outer circumference of a conductive shaft body, wherein said elastic layer is an unfoamed body having a addition curing type liquid silicone rubber cured as a base polymer, and the ASKER C hardness of this unfoamed body is 10° to 50°.

2. An image forming apparatus comprising: a semiconductive roller comprising an elastic layer formed on the outer circumference of a conductive shaft body, wherein said elastic layer is an unfoamed body having addition curing type liquid silicone rubber cured as a base polymer, and the ASCA C hardness of this unfoamed body is 10° to 50°.

* * * * *